US006863179B2

(12) United States Patent
Leykin et al.

(10) Patent No.: US 6,863,179 B2
(45) Date of Patent: Mar. 8, 2005

(54) CONTAINER FOR CONTAINING, TREATING AND DISPENSING A BUN IN A HOT DOG DISPENSING MACHINE

(75) Inventors: Leonid Leykin, Baltimore, MD (US); Aleksandr Kofman, Rockville, MD (US); Leonid Khodor, Orange, OH (US)

(73) Assignee: LHD Vending, Inc., Owens Mill, MD (US)

( * ) Notice: Subject to any disclaimer, the term of this patent is extended or adjusted under 35 U.S.C. 154(b) by 0 days.

(21) Appl. No.: 09/953,744

(22) Filed: Sep. 17, 2001

(65) Prior Publication Data

US 2003/0173248 A1 Sep. 18, 2003

(Under 37 CFR 1.47)

(51) Int. Cl.[7] ..... B65D 25/02

(52) U.S. Cl. ..... 206/565; D7/554.2; 220/608; 426/115

(58) Field of Search ..... D7/550.1, 554.1, D7/554.2, 554.3, 554.4; 99/645, 646 C; 220/556, 608; 221/25, 73, 89; 229/903, 904, 938, 406, 407, 902; 426/115, 129, 128; 206/525, 557, 564, 565, 719

(56) References Cited

U.S. PATENT DOCUMENTS

| | | | | | |
|---|---|---|---|---|---|
| 2,920,805 | A | * | 1/1960 | Reifers | 229/407 |
| 3,128,030 | A | * | 4/1964 | Davies | 229/406 |
| 3,365,308 | A | * | 1/1968 | Janicke | 206/525 |
| 4,009,817 | A | * | 3/1977 | Marchall et al. | 229/406 |
| 4,573,579 | A | * | 3/1986 | Murdick et al. | 206/525 |
| 4,883,195 | A | * | 11/1989 | Ott et al. | 229/406 |
| 5,131,551 | A | * | 7/1992 | Wells | 229/406 |
| 5,392,945 | A | * | 2/1995 | Syrek | 220/608 |
| 5,400,699 | A | | 3/1995 | Cailbault | |
| 5,429,833 | A | * | 7/1995 | Wyslotsky | 426/128 |
| 5,518,120 | A | * | 5/1996 | Ahm et al. | 206/719 |
| 6,048,558 | A | * | 4/2000 | Feldmeier et al. | 426/128 |
| 6,383,542 | B1 | | 5/2002 | Khodor et al. | |

OTHER PUBLICATIONS

Declaration of Leon Leykin with attachment 1 (pp. 1, 21a, and 28a) (Jul. 19, 2002).

Affidavit of Leonid Khodor (Jun. 23, 2003).

* cited by examiner

*Primary Examiner*—Jim Foster
(74) *Attorney, Agent, or Firm*—Steven B. Kelber; DLA Piper Rudnick; Gray Cary US LLP

(57) ABSTRACT

A container for containing, treating and dispensing a bun in a hot dog dispensing machine has a container element having an inner cavity for accommodating a bun, an open side an a bottom located opposite to the open side, and a projection provided on the bottom and formed so that it supports a bun accommodated in the cavity and can be engaged by a formation of transporting means for transporting the container with the bun.

6 Claims, 3 Drawing Sheets

CONTAINER FOR CONTAINING, TREATING AND DISPENSING A BUN IN A HOT DOG DISPENSING MACHINE

BACKGROUND OF THE INVENTION

The present invention relates to containers for containing, treating and dispensing buns in hot dog dispensing machines.

Containers for holding buns are generally known. They usually have a container element with a cavity for accommodating a bun. It is believed that the known containers can be further improved, especially for the use in hot dog dispensing machines.

SUMMARY OF THE INVENTION

Accordingly, it is an object of the present invention to provide a container for containing, treating and dispensing a bun in a hot dog dispensing machine, which is a further improvement of the existing containers.

In keeping with these objects and with others which will become apparent hereinafter, one feature of present invention resides, briefly stated, in a container for containing, treating and dispensing a bun in a hot dog dispensing machine, which has a container element having an inner cavity for accommodating a bun, an open side and a bottom located opposite to said open side, and a projection provided on said bottom and formed so that it supports a bun accommodated in said cavity and can be engaged by a formation of transporting means for transporting the container with the bun.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1A:
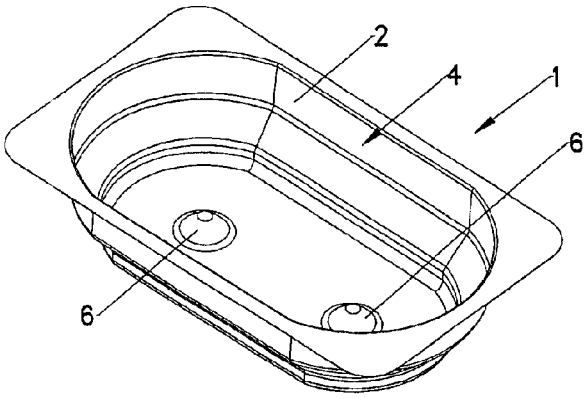
FIG. 1A is a perspective view of a container for containing, treating and dispensing a bun in a hot dog dispensing machine, in accordance with the present invention.
Figure 1B:
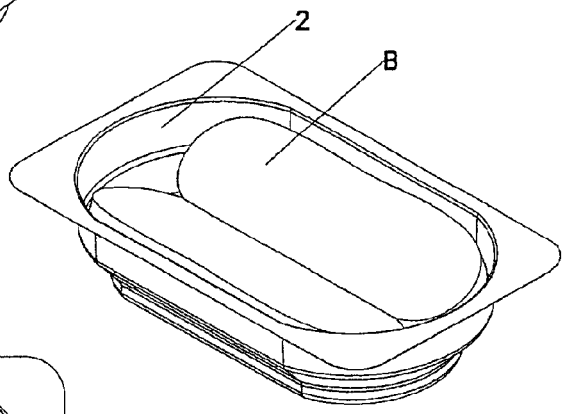
FIG. 1B is the same with a bun.
Figure 2:
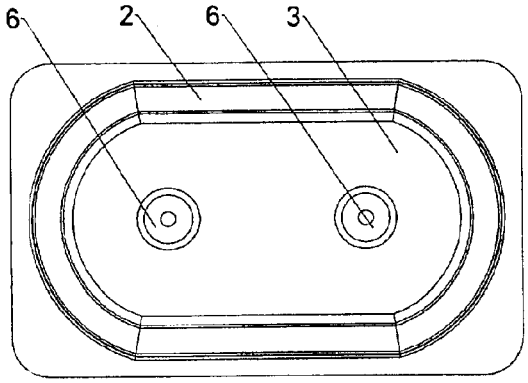
FIG. 2 is a plan view of a container for containing, treating and dispensing a bun in a hot dog dispensing machine.
Figure 3:
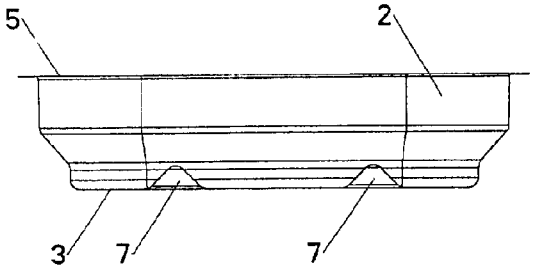
FIGS. 3 and 4 are a longitudinal section and a transverse section views of the container for containing, treating and dispensing a bun in a hot dog dispensing machine.

A container for containing, treating and dispensing a bun in a hot dog dispensing machine has a container element which is identified as a whole with reference numeral 1. The container element 1 has a peripheral wall 2 which together with a bottom 3 forms an inner cavity 4 for accommodating a bun. The container has an open side 5 which is opposite to said bottom 3. As can be seen from the drawings, the container is somewhat elongated in one direction and has rounded wall portions at the longitudinal ends of the container.

Figure 4:
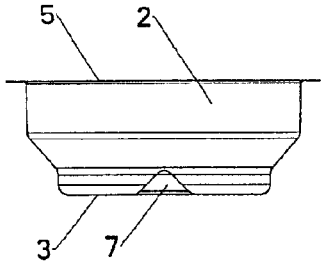
Figure 5:
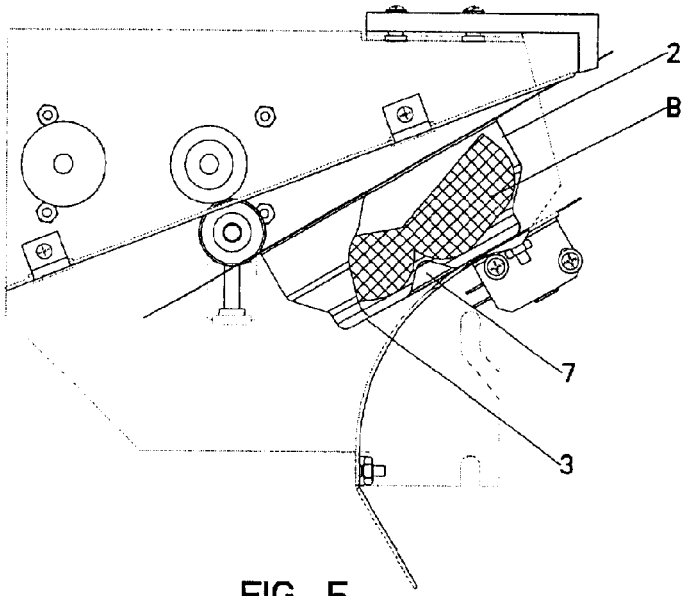
FIG. 5 is a local sectional view, showing a container with a bun on the last stage of the bun dispenser.
Figure 6A:
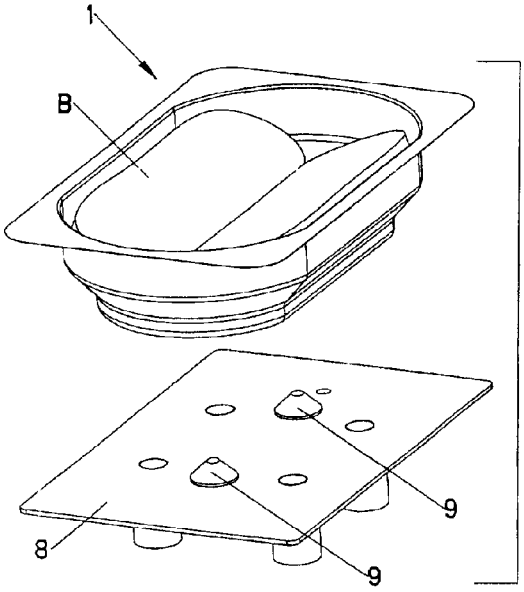
FIG. 6A is an exploded view showing the container with bun in accordance with the present invention on a transporting platform.
Figure 6B:
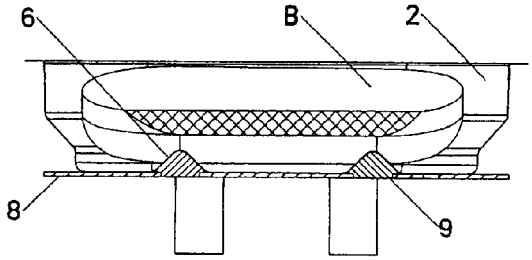
FIG. 6B is a longitudinal sectional view, showing the container on a transporting platform.

A projecting structure is further provided in a container. It includes at least one, but preferably two projections identified with reference numeral 6. The projections 6 are formed on the bottom 3 of the container and extend into the inner cavity 4 of the container. As can be seen from FIG. 4, the projections are located substantially on a longitudinal axis of symmetry of the container so that they can support a bun which is identified as a whole with reference numeral B in its central area. The side walls of the container are formed so that the sides of the bun B are supported on them. For this purpose, each side wall can be for example curved as shown in FIG. 4. A vertical upper portion of the side wall is connected with a vertical lower portion of the side wall by an intermediate inclined wall portion. The sides of the open bun B are supported preferably on the intermediate inclined wall portions of the side wall of the container as shown in FIG. 4.

The projections 6 are hollow and each define a lower opening 7. The container 1 can be arranged on a transporting platform which is identified with reference numeral 8 so that the projections 6 are fitted with their lower openings 7 onto projections 9 extending upwardly from the transporting platform. When the container 1 with the bun B is transported on the transporting platform 8 it is reliably held by interengagement of the lower openings 7 of the projections 6 on the projections 9 of the transporting platform 8.

Figure 7A:
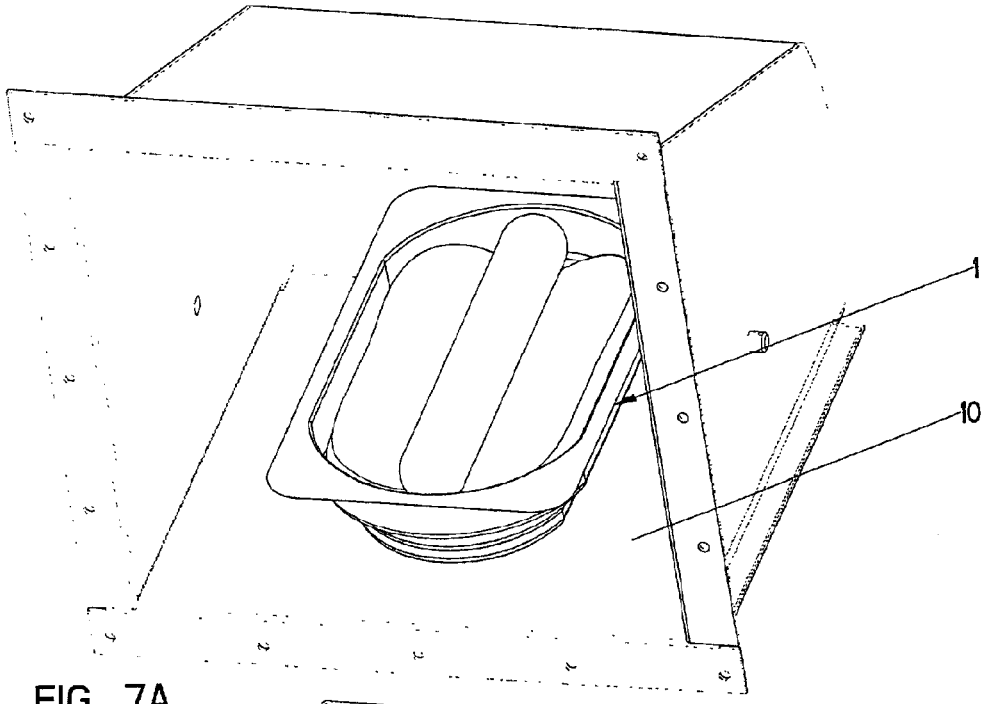
FIG. 7A is a view showing the container with bun and hot dog in accordance with the present invention which is removed form the transporting platform and transferred to a dispensing window of a hot dog dispensing machine.
Figure 7B:
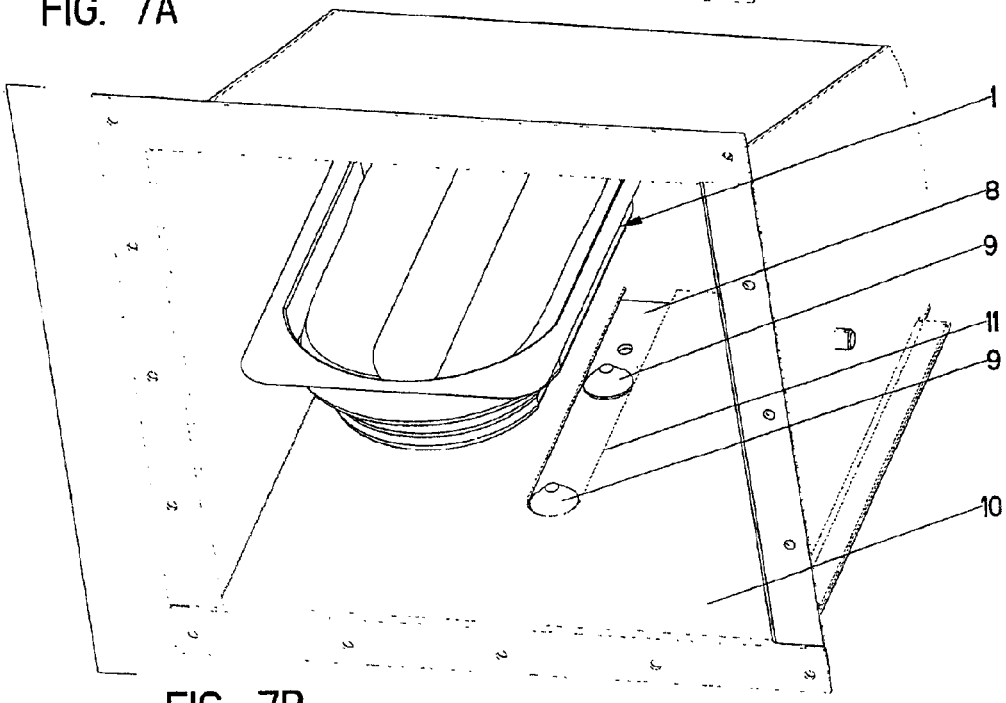
FIG. 7B is the same, but with an exploded view.

The container 1 with the buns are transported to a dispensing window of the hot dog dispensing machine which is shown in FIGS. 7A and 7B. The dispensing window has a dispensing platform 10 provided with an elongated slot ii. When the transporting platform is displaced under the dispensing platform 10, the container 1 with the bun inside is moved onto the upper surface of the dispensing platform 10, the projections 9 of the transporting platform are moved in the slot 11 to the right and then to the left in FIG. 7B, and the container 1 together with the bun B in it is left on the dispensing platform 10.

It is believed that instead of two projections, the container bottom can be provided with somewhat different means which will support the bun and at the same time serve for being temporarily held on the transporting platform.

It will be understood that each of the elements described above, or two or more together, may also find a useful application in other types of constructions differing from the types described above.

While the invention has been illustrated and described as embodied in a container for containing, treating and dispensing a bun in a hot dog dispensing machine, and a containing, treating and dispensing mechanism of the later, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A container for containing, treating and dispensing a bun in a hot dog dispensing machine, comprising a container element having an inner cavity for accommodating a bun, an open side and a bottom located opposite to said open side, walls, and at least two projections extending from said bottom into an interior of said cavity and operative for supporting a bun accommodated in said cavity substantially in a central portion of the bun, so as to hold the bun in an unfolded condition, said at least two projections being remotely spaced from all walls of the container, located only on a longitudinal axis of symmetry, higher than any portion of the bottom on any side of said longitudinal axis of symmetry, and cone-shaped and hollow allowing the container to be engaged and centered on a transporting platform provided with a corresponding formation, for transporting the container with the bun on the transporting platform to a dispensing chamber.

2. A container as defined in claim 1, wherein said projection includes at least two projecting elements which are spaced from one another in a transverse direction.

3. A container as defined in claim 1, wherein said container has side walls formed so that sides of a bun are supportable on said side walls.

4. A container as defined in claim 3, wherein each of said side walls has a curved shape including a substantially straight part, a substantially inclined intermediate part and another substantially straight part connected with said bottom.

5. The container of claim 1, wherein the at least two projections are formed in order to split and support a bun accommodated in said cavity.

6. A container for containing, treating and dispensing a bun in a hot dog dispensing machine, comprising an elongated container element having an inner cavity for accommodating a bun, an open side and a bottom located opposite to said open side, long walls, short walls, and at least two projections extending from said bottom into an interior of said cavity and operative for supporting a bun accommodated in said cavity substantially in a central portion of the bun, so as to hold the bun in an unfolded condition, said at least two projections being remotely spaced from the long walls of the container, located on a longitudinal axis of symmetry, higher than any portion of the bottom on any side of said longitudinal axis of symmetry, and cone-shaped and hollow allowing the container to be engaged and centered on a transporting platform provided with a corresponding formation, for transporting the container with the bun on the transporting platform to a dispensing chamber.

* * * * *